US008681008B2

(12) United States Patent
Jimenez et al.

(10) Patent No.: US 8,681,008 B2
(45) Date of Patent: Mar. 25, 2014

(54) PERSONAL CARE IMPLEMENT HAVING A DISPLAY

(75) Inventors: Eduardo Jesus Jimenez, Manalapan, NJ (US); Dong Ho Yun, Bayside, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/433,785

(22) Filed: Mar. 29, 2012

(65) Prior Publication Data

US 2012/0180234 A1 Jul. 19, 2012

Related U.S. Application Data

(63) Continuation of application No. 11/853,078, filed on Sep. 11, 2007, now Pat. No. 8,159,352.

(51) Int. Cl.
*G08B 23/00* (2006.01)

(52) U.S. Cl.
USPC ..... 340/573.1; 340/682; 340/693.5; 340/687; 15/167.1

(58) Field of Classification Search
USPC ..... 340/573.1, 682, 693.5, 687; 15/167.1, 15/105, 22.1; 132/331, 308, 309
See application file for complete search history.

(56) References Cited

U.S. PATENT DOCUMENTS

| | | | | |
|---|---|---|---|---|
| 3,512,202 | A | 5/1970 | Taylor | |
| 3,998,234 | A | 12/1976 | Stubbmann | |
| 4,716,614 | A | 1/1988 | Jones et al. | |
| 5,337,435 | A | 8/1994 | Krasner et al. | |
| 5,438,726 | A | 8/1995 | Leite | |
| 5,485,646 | A * | 1/1996 | Merritt | 15/105 |
| 5,673,451 | A | 10/1997 | Moore et al. | |
| 5,810,601 | A | 9/1998 | Williams | |
| 6,397,424 | B1 | 6/2002 | Leung | |
| 6,536,068 | B1 * | 3/2003 | Yang et al. | 15/105 |
| 6,735,802 | B1 * | 5/2004 | Lundell et al. | 15/22.1 |
| 6,753,842 | B1 | 6/2004 | Williams et al. | |
| 6,754,928 | B1 | 6/2004 | Rosen | |
| 6,786,732 | B2 * | 9/2004 | Savill et al. | 434/263 |
| 6,850,167 | B2 | 2/2005 | Rosen | |

(Continued)

FOREIGN PATENT DOCUMENTS

| | | |
|---|---|---|
| DE | 4029770 | 3/1992 |
| DE | 19811676 | 9/1999 |

(Continued)

OTHER PUBLICATIONS

International Preliminary Report on Patentability of International Application No. PCT/US08/073534, mailed Mar. 16, 2010.

(Continued)

*Primary Examiner* — Hoi Lau
(74) *Attorney, Agent, or Firm* — Ryan M. Flandro

(57) ABSTRACT

A personal care implement or toothbrush includes a sensor for detecting a position of the toothbrush and orientation display for providing content to a user. The display may be configured to present content in a mirror-image format. The personal care implement may be configured to operate in one or more modes of operation. One or more components may be included for setting variables associated with the modes of operation, for changing an orientation of the displayed content between a mirror-image format and forward-facing format, and for changing the particular mode of operation.

14 Claims, 5 Drawing Sheets

(56) References Cited

U.S. PATENT DOCUMENTS

| | | | | |
|---|---|---|---|---|
| 7,357,585 | B2 | 4/2008 | Kurashina | |
| 7,411,511 | B2 * | 8/2008 | Kennish et al. | 340/573.1 |
| 7,414,831 | B1 | 8/2008 | Brown et al. | |
| 8,065,164 | B2 * | 11/2011 | Hwang | 705/2 |
| 8,159,352 | B2 * | 4/2012 | Jimenez et al. | 340/573.1 |
| 8,176,591 | B2 * | 5/2012 | Iwahori et al. | 15/22.1 |
| 2002/0012047 | A1 | 1/2002 | Imoto | |
| 2002/0183959 | A1 * | 12/2002 | Savill et al. | 702/150 |
| 2003/0063011 | A1 * | 4/2003 | Rosen | 340/687 |
| 2003/0160736 | A1 | 8/2003 | Faso et al. | |
| 2004/0201595 | A1 * | 10/2004 | Manchester | 345/649 |
| 2005/0027882 | A1 | 2/2005 | Sullivan et al. | |
| 2005/0044646 | A1 | 3/2005 | Peretz et al. | |
| 2005/0260535 | A1 | 11/2005 | Costaras et al. | |
| 2005/0260536 | A1 | 11/2005 | Costaras et al. | |
| 2005/0276164 | A1 | 12/2005 | Amron | |
| 2006/0125769 | A1 | 6/2006 | Ding | |
| 2006/0141421 | A1 | 6/2006 | Braunecker et al. | |
| 2006/0161079 | A1 * | 7/2006 | Choi et al. | 600/595 |
| 2006/0283555 | A1 | 12/2006 | Green | |
| 2007/0058490 | A1 * | 3/2007 | Stange et al. | 368/10 |
| 2007/0182571 | A1 * | 8/2007 | Kennish et al. | 340/573.1 |
| 2007/0206350 | A1 | 9/2007 | Shimamoto et al. | |
| 2007/0257792 | A1 | 11/2007 | Gold | |
| 2007/0279511 | A1 | 12/2007 | Misawa | |
| 2008/0066355 | A1 | 3/2008 | Misawa et al. | |
| 2008/0109973 | A1 * | 5/2008 | Farrell et al. | 15/4 |
| 2008/0151092 | A1 | 6/2008 | Vilcovsky | |
| 2008/0184511 | A1 | 8/2008 | Brown et al. | |
| 2009/0064430 | A1 * | 3/2009 | Jimenez et al. | 15/22.1 |
| 2009/0092955 | A1 * | 4/2009 | Hwang | 434/263 |
| 2009/0104942 | A1 | 4/2009 | Arakane et al. | |
| 2009/0130636 | A1 * | 5/2009 | Hwang | 433/216 |
| 2010/0106336 | A1 * | 4/2010 | Hwang et al. | 700/280 |
| 2010/0136957 | A1 | 6/2010 | Horodezky et al. | |
| 2011/0041269 | A1 * | 2/2011 | Iwahori | 15/22.1 |
| 2011/0260872 | A1 * | 10/2011 | Kennish et al. | 340/573.1 |
| 2012/0180234 | A1 * | 7/2012 | Jimenez et al. | 15/105 |

FOREIGN PATENT DOCUMENTS

| | | |
|---|---|---|
| DE | 10045067 | 4/2002 |
| DE | 102005044018 | 3/2007 |
| GB | 2230942 | 11/1990 |
| WO | WO 06/137661 | 12/2006 |
| WO | WO 07/068984 | 6/2007 |

OTHER PUBLICATIONS

International Search Report and Written Opinion in International Application No. PCT/US08/073534, mailed Nov. 11, 2008.

Goehl et al., 2008, Motion Sensors Gaining Inertia with Popular Consumer Electronics, InvenSense White Paper [Unknown publication date].

* cited by examiner

PERSONAL CARE IMPLEMENT HAVING A DISPLAY

CROSS-REFERENCE TO RELATED APPLICATIONS

The present application is a continuation of U.S. patent application Ser. No. 11/853,078, filed on Sep. 11, 2007, now allowed, the content of which is hereby incorporated by reference in its entirety.

BACKGROUND OF THE INVENTION

The present invention pertains to a personal care implement, in particular, to a toothbrush with sensors. Tooth brushing is part of a daily oral hygiene activity. Dentists generally recommend that an individual brush his or her teeth for a minimum interval per cleaning, such as two minutes. Despite such recommendations, many individuals, especially young children, do not regularly brush their teeth for the recommended minimum interval.

BRIEF SUMMARY OF THE INVENTION

The invention pertains to a personal care implement including a care region for engaging an anatomical region of an organism, a body for gripping the implement and a sensor to detect the position of the personal care implement.

In a further aspect, the sensor detects a rotation of the body about an axis normal to a longitudinal axis of the body.

In yet another aspect, the sensor is an accelerometer.

In another aspect, the personal care implement includes a display to provide information to a user of the implement.

In another aspect, the personal care implement may include at least one actuator configured to change a mode of operation of the oral care implement.

In yet another aspect, the implement may include at least one actuator configured to change an orientation of the content on the display of the oral care implement.

In another aspect, the implement includes a sensor configured to rotate the content being presented upon detection of a rotation of the oral care implement about an axis.

Other features and advantages of the invention will become apparent from the following description taken in conjunction with the following drawings.

DETAILED DESCRIPTION OF THE INVENTION

In the following description, the invention is discussed in terms of a toothbrush (e.g. a form of an oral care implement) but could be in the form of other personal care implements, such as a hair dryer. The personal care implement is normally used by a human for personal hygiene. For example, a toothbrush can be used for personal hygiene, such as oral care purposes. Further, it is understood that other embodiments may be utilized and structural and functional modifications may be made without departing from the scope of the present invention.

Figure 1A:
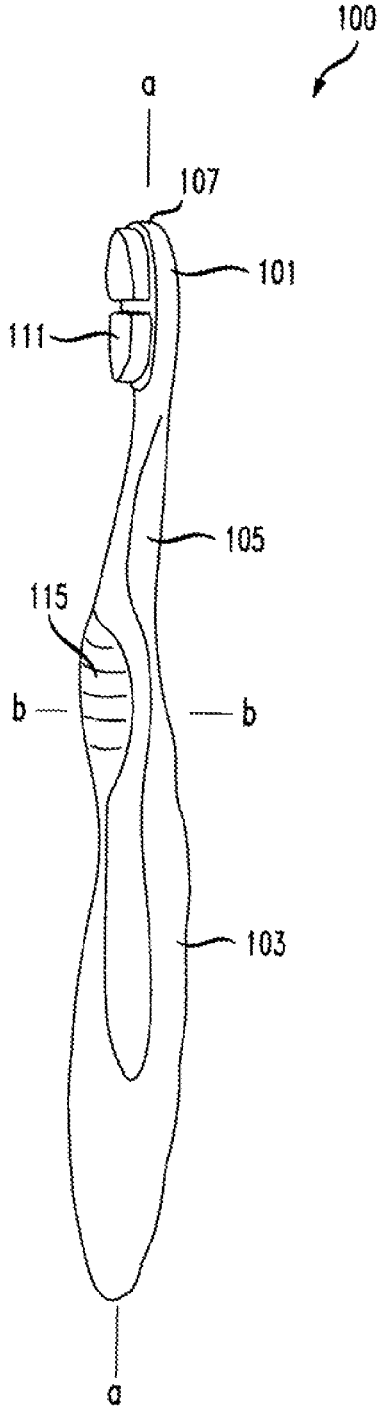
FIGS. 1A-1B are perspective front and rear views of an oral care implement, such as a toothbrush, according to one or more embodiments of the invention.
Figure 1B:
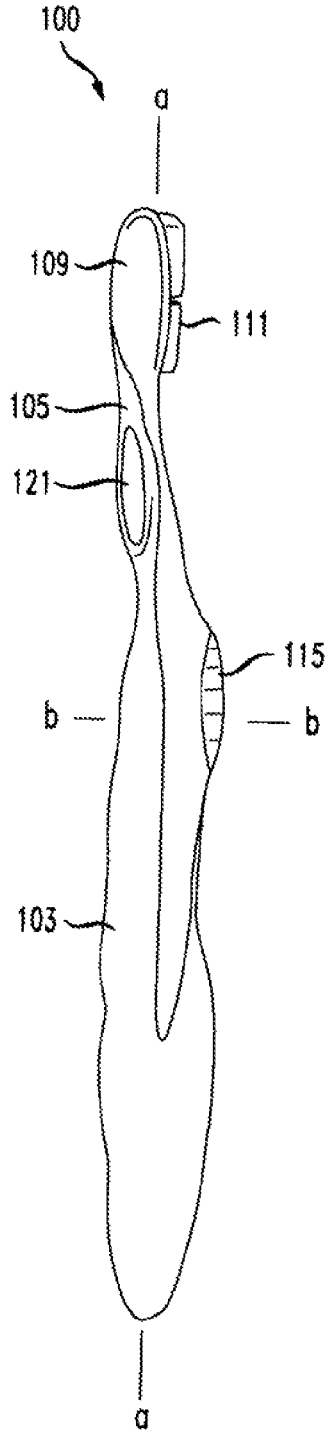

FIGS. 1A-1B illustrate an oral care implement, such as a toothbrush, generally designated with the reference numeral 100. The toothbrush 100 generally includes a head 102 and a handle 103.

The handle 103 is generally an elongated member dimensioned so that a user can readily grip and manipulate the toothbrush 100. The handle 103 may be formed of many different shapes, lengths and with a variety of constructions. In one construction, the handle 103 has a neck portion 105 positioned adjacent the head 101. The neck portion 105 may be a narrowed region on the handle 103 between head 101 and the part of the handle normally gripped by the user. Nevertheless, the neck portion 101 could be the region between the head 101 and the part of the handle normally gripped by the user. In another construction, the handle 103 is integrally formed with the head 101. Other attachment configurations also are possible.

The head 101 may include an oral care region comprising one or more tooth cleaning elements 111. As used herein, the term "tooth cleaning elements" or "cleaning elements" includes any type of structure that is commonly used or is suitable for use in providing oral health benefits (e.g., tooth cleaning, tooth polishing, tooth whitening, massaging, stimulating, etc.) by making contact with portions of the teeth and gums. Such tooth cleaning elements include but are not limited to tufts of bristles that can be formed to have a number of different shapes and sizes and elastomeric cleaning members that can be formed to have a number of different shapes and sizes, or a combination of both tufts of bristles and elastomeric cleaning members.

In one construction, the one or more tooth cleaning elements 111 are formed from a plurality of bristles. Referring to FIGS. 1A-1B, the tooth cleaning elements 111 are bristle regions having different shapes, however, it is understood that a number of different configurations of oral care implements may be utilized. The one or more tooth cleaning elements 111 may be attached to the head 101 by known methods, such as being fit within recesses formed in the head 101 along a front portion 107 of the toothbrush 100 (FIG. 1A). The head 101 also may be configured to be detached from the neck 105 or handle 103 and replaced with a new head 101 when the previous head 101 wears out and should be replaced.

In another construction, toothbrush 100 may be a powered toothbrush including a power source that drives a powered element, such as movable cleaning elements 111 with an activation/deactivation or "on/off" button (not shown).

FIG. 1A illustrates a front portion 107 of the toothbrush 100 and FIG. 1B shows a rear portion 109 of the toothbrush 100. In the illustrative FIGS. 1A-1B, a thumb gripping portion 115 is also shown. A user may hold the toothbrush 100 with their thumb resting on gripping portion 115. Thumb gripping portion 115 may be formed of a pliable, cushioning material that is depressible as a user presses their thumb against it. In one or more constructions, as described herein, the thumb gripping portion 115 may serves as an actuator. For example, portion 115 may act as a button to turn an electronic device associated with the toothbrush 100 "on" and/or "off," a button to change a mode of operation of an electronic device associated with the toothbrush 100, and/or a button to change an orientation of the content of a display associated with the toothbrush 100.

Referring to FIG. 1B, display 121 presents symbolic or graphical content for viewing by a user. The symbolic or graphical content may include characters or images associated with digital data. In one construction, the content may include video clips or other moving images and characters for dynamic viewing by a user. Display 121 is disposed within the neck portion 105 on the back portion 109 of the toothbrush 100. In this arrangement, the oral care region is oriented in a first direction (e.g., extending away from the front portion 107) and the display is oriented in a second direction opposed to the first direction. Display 121 may be a liquid crystal display (LCD) or a light emitting diode (LED) type display among other types. For example, display may be an Organic LED that can be tuned to provide a desired luminescent characteristic such as color, temperature, intensity etc. OLED technology can be embedded into the toothbrush molding, or can be applied to the surface of the toothbrush body. It should be understood by those skilled in the art that the present invention is not limited to any particular type of display.

FIGS. 2A-6B illustrate alternative constructions of the oral care implement, generally designated with the reference numerals 200, 300, 400, 500, and/or 600, respectively. For ease of explanation, similar structures will be referred to with similar reference numerals, using a 200, 300, 400, 500, or 600 series numerals.

Figure 2A:
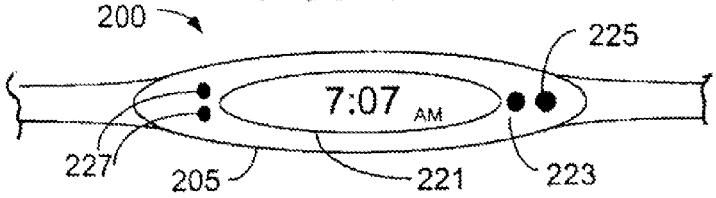
FIGS. 2A-6B are enlarged views of the implement portions with a display.
Figure 2B:
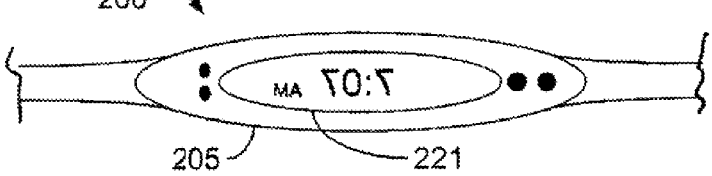

FIGS. 2A-2B illustrate a display region of a toothbrush according to one or more embodiments. As shown in FIG. 2A, a toothbrush 200 includes a display 221 disposed within the neck portion 205. Although shown in the neck portion 205, it should be understood that other areas of the toothbrush 200 may be utilized to house the display 221. For example, the display could be located in the handle region on the side opposite the tooth cleaning elements 111. As shown in FIG. 2A, the content of the display 221 refers to a time of day for clock reading, i.e., 7:07 AM. Display 221 may also present other content such as the current day, month, year, or century; future appointments or meeting reminders. In this arrangement, the display 221 functions as clock device or time piece.

As shown in FIG. 2A, toothbrush 200 may include two setting actuators 227. In this example, setting actuators 227 may be configured to allow a user to depress, or otherwise engage, one or more of the actuators 227 to set an hour and a minute for the time of day. A single actuator 227 and/or more than two actuators 227 may be utilized for toothbrush 200. For example, a third setting actuator 227 may be included to set the time with a designation of AM or PM.

One or more additional actuators may be included to perform a variety of functions. As shown in FIG. 2A, two additional actuators 223 and 225 are shown. In this example, actuators 223 and 225 may be push buttons. In other examples, actuators 223, 225, and 227 may be other types of input actuators. For example, they may be a switch or other type of input mechanisms or devices. In this example, actuator 223 may be a mode selection actuator. Actuator 223 allows a user to change the mode of operation of the display 221 to any of a number of different operations. For example, and as described with respect to FIG. 2A and 2B, depression or other engagement of actuator 223 may change the mode of operation to present a time of day or clock reading on the display 221. A subsequent engagement of actuator 223, may change the mode of operation to a stroke counter, as illustrated in the example shown in FIGS. 3A and 3B. A further subsequent engagement of actuator 223 may change the mode of operation to a countdown or count-up timer, as illustrated in the example shown in FIGS. 4A and 4B. Nevertheless, the specific order of the engagement events of the actuator 223, does not limit the scope of the invention.

In one construction, the presented content changes corresponding to the change in time when operating in a mode to display a time of day for clock reading on the display 221. In addition, the designation of AM may change to PM when the $12^{th}$ hour of the day has been reached. Similarly, the PM designation may change to AM when midnight is reached. Although described herein as a clock reading, the display 221 in this mode of operation may present the current date or future date in lieu of, or in combination with the presented time.

Returning to the example in FIG. 2A, actuator 225 may serve as an orientation actuator for the content presented in display 221. In one operation, when display 221 is in a forward facing direction for viewing by the user, the content shown on the display 221 in FIG. 2A may be easily read in a left to right direction by the user (e.g., a forward-facing format). However, when the display 221 is in a rear-facing direction away from the user, the content is blocked from the view of the user. Furthermore, in the rear facing arrangement of display 221, when the content is viewed as an image on a reflective surface, the image of the display 221 is reversed with respect to the forward facing direction.

In a construction of toothbrush 200, upon depression or other engagement of the orientation actuator 225, the content presented on the display 221 is changed to a mirror-image of the original content. Accordingly, the original content shown in the display 221 in FIG. 2A is re-oriented or re-formatted to the content shown in FIG. 2B, where the content is now in a right to left direction. For example, in FIG. 2B, the time of 7:07 AM is still shown, but is now in a mirror-image format. The original content which would normally be read in a left to right direction in the English language is now presented in a right to left direction. In this example, when the content is reversed in the display 221 as seen in FIG. 2B (e.g., in a mirror-image format), the display can be clearly read as 7:07 AM when viewed as a reflected image from a mirrored surface. This configuration is helpful to a user when the display 221 is in a rear-facing direction, such as when the user is brushing in front of a mirror (e.g. a front facing toward a mirror). In this manner, the user can readily determine the information presented on the display by viewing the reflective image in the mirror without having to momentarily stop brushing. Nevertheless, upon depression/engagement of orientation actuator 225, the content in mirror-image format may change to that shown in FIG. 2A for forward face viewing by the user. While the discussion refers to the English language reading direction, the inventive aspects may be practiced in other languages as well, such as Spanish, French, Chinese, Arabic, Russian, French, etc.

Figure 3A:
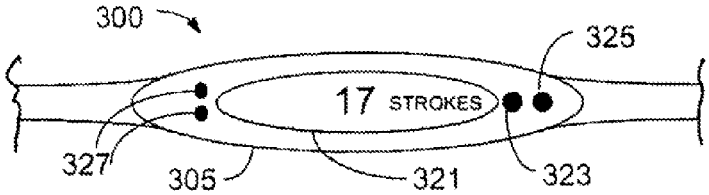
Figure 3B:
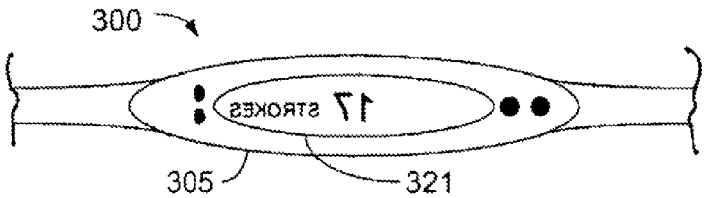

FIGS. 3A-3B illustrate another construction of a toothbrush 300 in which the content relates to a stroke counter. In FIG. 3A, toothbrush 300 includes a display 321 disposed in the body or a neck portion 305 of the toothbrush 300. The stroke counter mode of operation may be obtained by depression of one of the actuators. In this example, upon engagement of actuator 323, a user may switch from the time of day operation mode to the stroke counter operation. In the stroke counter mode, the number of brush strokes is tracked and counted by the toothbrush 300. By using actuators 327, a user may set a target number of strokes to be counted before an alarm (e.g., a sound or visible notification) is activated and/or the user may set a number of strokes to be counted down before an alarm is deactivated. Different stroke counts may be implemented at one time. For example, a user may track the total number of brush strokes, while also independently tracking the number of strokes in a particular area of his or her mouth. The information may be stored separately to allow a user to monitor his or her brushing habits.

Similar to the mirror-image format of content in FIG. 2B, FIG. 3B illustrates a mirror-image format of the stroke count.

Upon depression or other engagement of actuator 325 in FIG. 3A, the content of display 321 may be reversed to show the stroke count, i.e., "17 strokes". A user can readily read at any time how many strokes have been counted or how many strokes remain to be counted via the reflection of the display 321 in a mirrored surface. Any number of different configurations of stroke counting or countdown may be implemented in accordance with aspects of the illustrative embodiments.

Figure 4A:
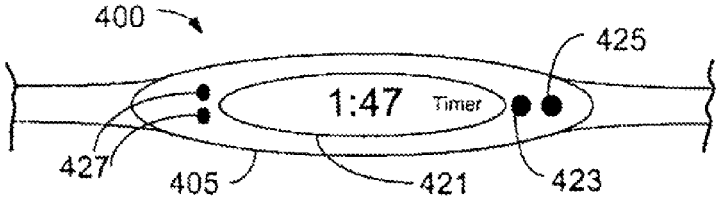
Figure 4B:
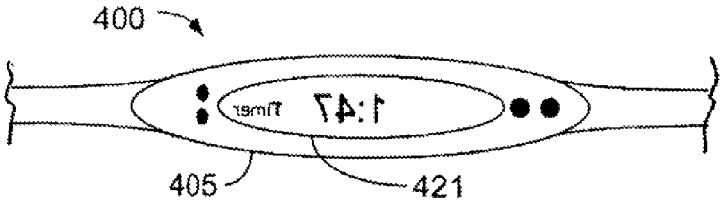

FIGS. 4A-4B illustrate another construction of a toothbrush 400 in which the content is a count up or countdown timer. In FIG. 4A, toothbrush 400 includes a display 421 disposed in body or a neck portion 405 of the toothbrush 400. The timer mode of operation may be obtained by depression of one of the actuators. In this example, upon depression of actuator 423, a user may switch from the stroke counter mode of operation to the timer mode of operation. In the timer mode of operation, the toothbrush 400 may act as a device to count up to a certain time or to count down from a certain time. This may be useful to individuals who strive to brush their teeth for the recommended total of at least two minutes, twice a day. In one example, an alarm may be configured to alert the user upon the timer reaching the specified end time.

Similar to the mirror-image format of the content in FIGS. 2B and 3B, FIG. 4B illustrates a mirror-image format of the elapsed or remaining brushing time. Upon depression of actuator 425 in FIG. 4A, the content to display 421 may be reversed to show 1:47 in mirror-image format. A user can readily determine how much time remains, whether counting down to zero or counting up to a particular end time, by viewing the display 421 as a reflection in a mirror. Any number of different configurations of counting up or counting down may be implemented in accordance with aspects of the illustrative embodiments.

Figure 5:
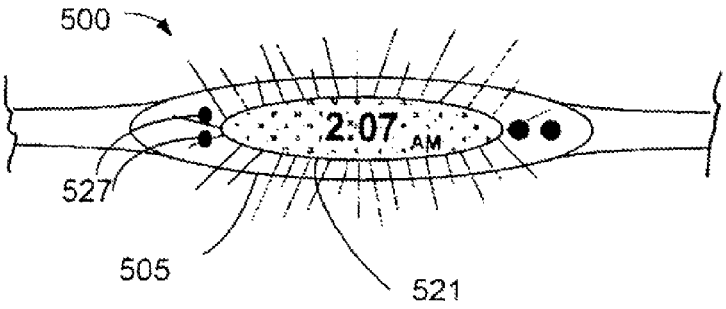

FIG. 5 illustrates another construction of a toothbrush 500. In FIG. 5, toothbrush 500 includes a display 521 disposed in body or a neck portion 505 of the toothbrush 500. In this example, display 521 includes a backlight feature. For example, OLED technology could be used in display 521 of toothbrush 500. With this feature, the toothbrush 500 may act as a nightlight during certain configurable times of day. As shown in FIG. 5, the backlight of display 521 is illuminated at 2:07 AM. A user may use the illuminated light from the backlight of the display 521 to see around a darkened room for orientation and may be able to tell the time at the same time. This feature may be implemented by depression or other engagement of one of the actuators.

In this example, a user may set the time period in which he/she desires the backlight to be in operation. For example, utilizing actuators 527, a user may set the backlight to operate between one or more predefined time periods, such as 11:00 PM to 6:00 AM, although it should be understood that any of a number of other settings may be configured. In an alternative embodiment, a light detection sensor may be included within the toothbrush 500 to detect the ambient light around the toothbrush 500. In one example, the sensor may be a photodiode or photoconductive sensor enabled read a light level of 0 to 100 Foot-Candles (FC). Upon falling below a particular lighting threshold, the toothbrush 500 may then automatically initiate operation of the backlight on the display 521. The body of the toothbrush 500 may have a small window (e.g., clear plastic) which receives ambient light for the sensor. For example, the window may be part of display 521 and the sensor may be provided in combination with the display 521.

Figure 6A:
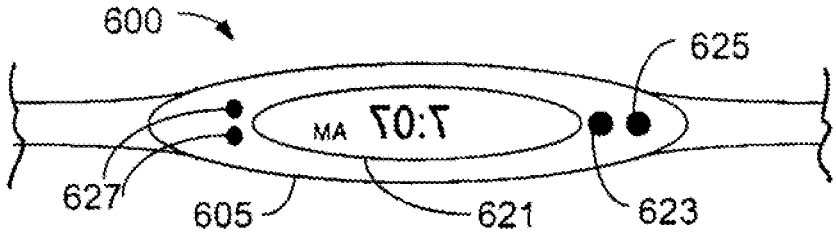
Figure 6B:
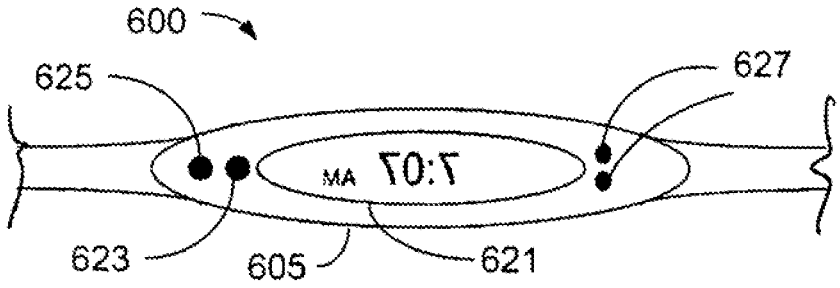

FIGS. 6A-6B illustrate another construction of a toothbrush 600. As shown in FIG. 6A, toothbrush 600 includes a display 621 disposed in a body or in a neck portion 605 of the toothbrush 600. In this example, the user may operate the toothbrush 600 in a time of day or clock reading mode of operation. Such may be the case where a user has depressed one or more of actuators 623, 625, and/or 627. As shown, the content of the display 621 is in a mirror-image format so the user may readily read the content as a reflection in a mirror. Referring to FIGS. 1A and 6A, the content is shown in which the graphic characters are presented along a longitudinal axis (a-a shown in FIG. 1A) of the display 621 and of the toothbrush 600. The toothbrush may be rotated clockwise or counter-clockwise about an axis b-b transverse to the longitudinal axis a-a of the toothbrush as shown in FIG. 1A. If the user rotates the toothbrush counter-clockwise 180° about axis b-b, the content of display 621 would be displayed upside down.

Referring to FIG. 6B, when toothbrush 600 is rotated 180° counter-clockwise, the content of display 621 also flips or rotates to maintain the mirror-image format. Therefore, when looking at the reflection of the display 621 in a mirror, a user may properly see the time or other information. Any of a number of different mechanisms may be utilized to track the position of the display and/or toothbrush. For example, a sensor, such as a gyroscopic sensor or an accelerometer, built into the toothbrush 600 may detect the relative change in position of the toothbrush 600 from a first state, to a second state, in which the toothbrush 600 has been rotated 180°. As should be understood, although described with respect to the time of day mode of operation, the description with respect to FIGS. 6A and 6B may be implemented with respect to other modes of operation of the toothbrush.

Referring to FIG. 6B, in an alternative construction, an accelerometer utilizing Micro-Electronic Mechanical System (MEMS) technology could be embedded in the toothbrush during molding, or could take the form of a sticker applied on the toothbrush body. A MEMS accelerometer device generates a signal representative of acceleration in a particular direction ("measurement direction"). The MEMS accelerometer detects gravitational force when not in motion. Accordingly, different altitudes of the MEMS accelerometer device with respect to the vertical can result in different readings which depend on the coincidence of the measurement direction with the direction of the gravitation pull. The detection of different altitudes may be used to detect the position of the toothbrush and the relative change in position from a first state or second state as discussed above.

Figure 7:
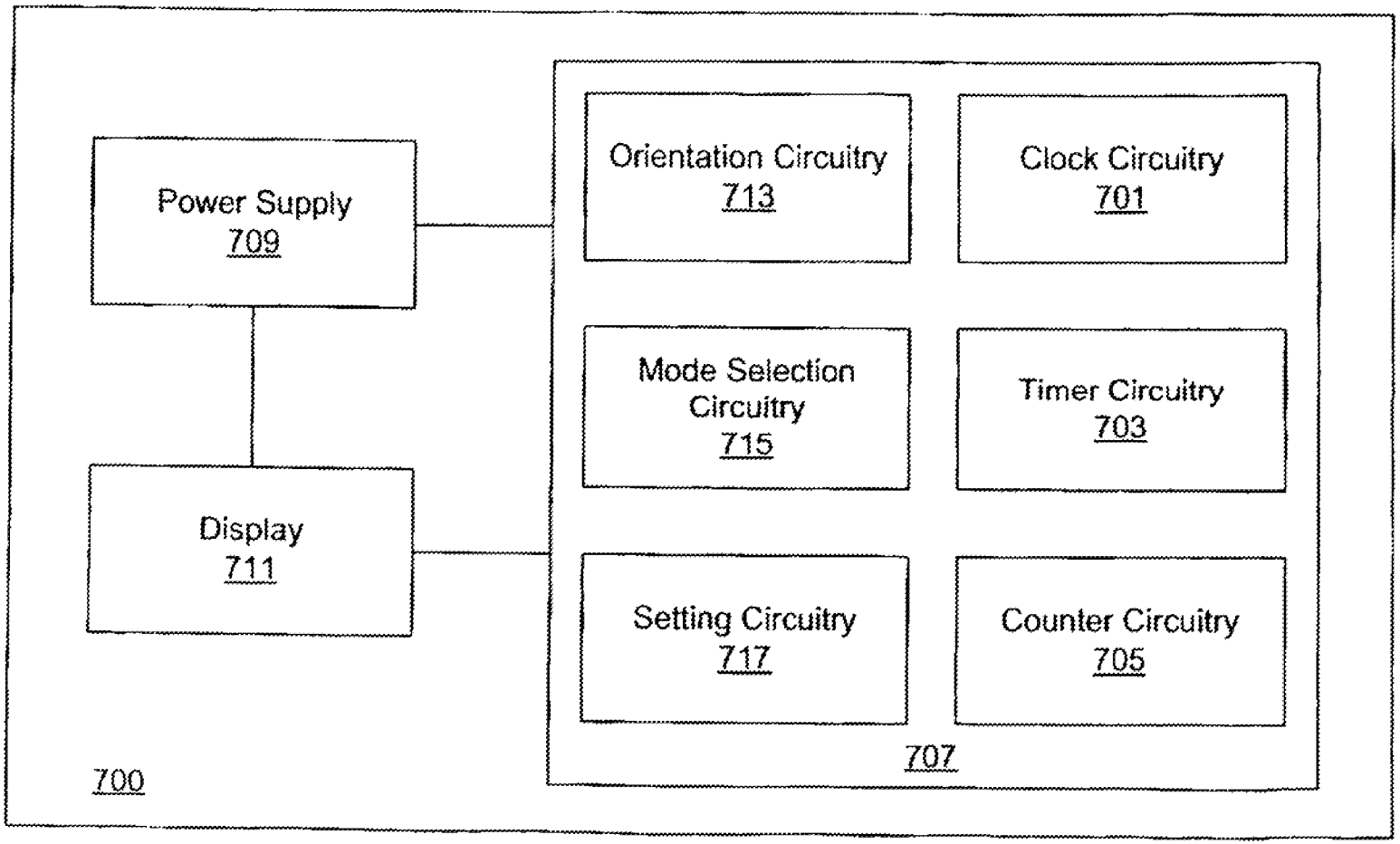
FIG. 7 is an example functional block diagram of components of the implement with an electronic display system according to one or more embodiments of the invention.

As described herein with respect to FIG. 7, a control system 707 of the toothbrush 100 may be included to provide content or image data for the display 121. FIG. 7 illustrates a block diagram of components in one or more constructions of toothbrush 100. One or more of the components shown in FIG. 7 may be included within one or more printed circuit boards. Toothbrush 700 includes control system 707, a power supply operatively connected to one or more elements of the system 707; and a display 711 operatively connected to one or more components of the system 707. Power supply 709 may include one or more power components, such as a battery or a wired connection to a power source, providing for electrical power to electrical components of the toothbrush 700.

Clock circuitry 701 may include hardware, software, computer-readable instructions, or other components to allow for tracking of the time of day and/or time of year and for outputting such information in a suitable form for use by the display 711. As such, clock circuitry 701 may include a crystal oscillator for counting seconds. Clock circuitry 701 may be configured to perform the functions for processing signal (s) performing computer-readable instructions, and reading from and writing to a memory (not shown) associated with the toothbrush 700 operating in a clock mode.

Timer circuitry 703 may include hardware, software, computer-readable instructions, or other components to allow for counting up or counting down time and for outputting such information in suitable form for use by the display 711. Timer circuitry 703 may include a crystal oscillator for counting seconds, minutes, etc. Timer circuitry 703 may be configured to perform the functions for processing signal(s) performing computer-readable instructions, and reading from and writing to a memory (not shown) associated with the toothbrush 700 operating in a timer mode.

Counter circuitry 705 may include any hardware, software, computer-readable instructions, or other components to allow for counting up or counting down strokes of the toothbrush 700 and for outputting such information in suitable form for use by the display 711. As such, counter circuitry 705 may include a sensor for detecting movement of the toothbrush. Counter circuitry 705 may be configured to perform the functions for processing signal(s), performing computer-readable instructions, and reading from and writing to a memory (not shown) associated with the toothbrush 700 operating in a stroke counter mode.

Orientation circuitry 713 may include hardware, software, computer-readable instructions, or other components to allow the content of display 711 to be selectively presented in a mirror-image format or forward-facing format, and for outputting such information in suitable form for use by the display 711. For example, orientation circuitry 713 may receive and process an input signal to cause display 711 and/or clock circuitry component 701, timer circuitry component 703, and/or counter circuitry component 705 to display an image on display 711. Orientation circuitry 713 may be configured to perform the functions for processing signal(s) performing computer-readable instructions, and reading from and writing to a memory (not shown) associated with the toothbrush 700 switching between a reversed content display and a non-reversed content display.

Mode selection circuitry 715 may include electrical circuitry, software, computer-readable instructions, or other components to allow for changing the mode of operation of the toothbrush 700. For example, mode selection circuitry 715 may receive and process an input signal to change the mode of operation from time of day mode of operation to timer mode of operation. Mode selection circuitry 715 may be configured to perform the functions for processing signal(s) performing computer-readable instructions, and reading from and writing to a memory (not shown) associated with the toothbrush 700 switching between different modes of operation.

Setting circuitry 717 may include electrical circuitry, software, computer-readable instructions, or other components to allow for setting one or more features of the toothbrush 700. For example, setting circuitry 717 may receive and process an input signal to set one or more features, such as the time of day, the month or year, the time to count up to, the time to count down from, the strokes to count up to, and/or the strokes to count down from. Setting circuitry component 717 is configured to perform the functions for processing signal(s) performing computer-readable instructions, and reading from and writing to a memory (not shown) associated with setting features of the toothbrush 700.

The inventive aspects may be practiced for a manual toothbrush or a powered toothbrush. While the various features of the toothbrush 100 work together to achieve the advantages previously described, it is recognized that individual features and sub-combinations of these features can be used to obtain some of the aforementioned advantages without the necessity to adopt all of these features.

It is understood that designations such as "first" and "second" are for illustrative purposes and can be interchanged. Further, a care region, such as a personal care region or oral care region, may engage a particular anatomical portion or region of an organism, such as a human body or mammal. The engagement may be physical abutment of the care region of the implement or movement a fluid, such as air or liquid, coming from the care region. In another example, the care region may have light coming from the region which contacts the user's anatomical portion. In one example, an oral care region may have cleaning elements or may direct a form of ultraviolet light to clean/whiten the teeth of a user. In a hair dyer example (e.g., a form of a personal care implement), a personal care region may include a comb or nozzle for directing forced air—heated or unheated onto a user's head, such as hair.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

We claim:

1. A toothbrush, comprising:

a head having tooth cleaning elements extending therefrom;

a body for gripping the toothbrush;

a sensor to detect a relative change in orientation of the body; and a control system;

wherein the sensor detects a rotation of the body about an axis normal to a longitudinal axis of the body and transmits signals to the control system indicative of the orientation of the body; and wherein upon receipt of the signals from the sensor, the control system automatically switching a first user perceptible output to a second user perceptible output.

2. The toothbrush of claim 1 wherein the sensor is an accelerometer.

3. The toothbrush of claim 1, further comprising a display, wherein the head is oriented in a first direction and the display is oriented in a second direction opposed to the first direction.

4. The toothbrush of claim 3, wherein the display is included within a neck portion of the body.

5. The toothbrush of claim 1, further comprising an actuator configured to change a mode of operation of the toothbrush, wherein the actuator is a push button.

6. The toothbrush of claim 5, wherein the actuator is configured to change the mode of operation of the toothbrush between a clock mode, a timer mode, and a counter mode.

7. The toothbrush of claim 5, further comprising an alarm associated with the change of the mode of operation.

8. The toothbrush of claim 1, further comprising a second sensor configured to track a number of brushing strokes of the toothbrush.

9. A toothbrush comprising:

a head having tooth cleaning elements extending therefrom;

a body for gripping the toothbrush;

a first sensor to detect a relative change in orientation of the body;

a second sensor configured to track a number of brushing strokes of the toothbrush;

a display that displays a remaining number of brushing strokes during a brushing session; and a control system;

wherein the sensor detects a rotation of the body about an axis normal to a longitudinal axis of the body and transmits signals to the control system indicative of the orientation of the body; and wherein upon receipt of the signals from the sensor, the control system automatically adjusts a user perceptible output.

10. The toothbrush of claim 8 wherein the control system actuates an alarm upon the number of brushing strokes reaching a predetermined threshold.

11. The toothbrush of claim 6 further comprising a display, and wherein when the toothbrush is in the clock mode, a time of day is displayed on the display, when the toothbrush is in the timer mode, a timer is displayed on the display, and when the toothbrush is in the counter mode, a stroke counter is displayed on the display.

12. The toothbrush of claim 1 wherein the signals indicative of the orientation of the body are transmitted from the sensor to the control system during brushing, and wherein the control system automatically switches the first user perceptible output to the second user perceptible output during brushing.

13. The toothbrush of claim 1 wherein upon receipt of the signals from the sensor, the control system immediately switches the first user perceptible output to the second user perceptible output.

14. A toothbrush, comprising:

a head having tooth cleaning elements extending therefrom;

a body for gripping the toothbrush;

a sensor to detect a relative change in orientation of the body; and a control system;

wherein the sensor detects a rotation of the body about an axis normal to a longitudinal axis of the body and transmits signals to the control system indicative of the orientation of the body; and wherein upon receipt of the signals from the sensor, the control system automatically switching a first user perceptible output being actively generated by the toothbrush to a second user perceptible output being actively generated by the toothbrush.

* * * * *